US005637958A

United States Patent [19]

Levine

[11] Patent Number: 5,637,958

[45] Date of Patent: Jun. 10, 1997

[54] GROOVED ANODE PLATE FOR CATHODOLUMINESCENT DISPLAY DEVICE

[75] Inventor: Jules D. Levine, Dallas, Tex.

[73] Assignee: Texas Instruments Incorporated, Dallas, Tex.

[21] Appl. No.: 399,316

[22] Filed: Mar. 6, 1995

[51] Int. Cl.[6] ..... H01J 1/62

[52] U.S. Cl. ..... 313/496; 313/462; 313/463; 313/474; 313/495

[58] Field of Search ..... 313/495, 496, 313/463, 466, 309, 310, 336, 351, 493, 634, 462, 474

[56] References Cited

U.S. PATENT DOCUMENTS

| | | | |
|---|---|---|---|
| 2,705,765 | 4/1955 | Geer | 313/461 |
| 2,769,111 | 7/1956 | Sadowsky | 313/461 |
| 3,761,756 | 9/1973 | Miura et al. | 313/474 |
| 5,055,737 | 10/1991 | Murata et al. | 313/463 |
| 5,097,175 | 3/1992 | Thomas | 313/466 |
| 5,206,746 | 4/1993 | Ooi et al. | 359/40 |
| 5,225,820 | 7/1993 | Clerc | 340/752 |
| 5,240,748 | 8/1993 | Van Esdonk et al. | 427/554 |
| 5,378,963 | 1/1995 | Ikeda | 313/495 |
| 5,477,105 | 12/1995 | Curtine et al. | 313/463 |
| 5,491,376 | 2/1996 | Levine et al. | 313/461 |

*Primary Examiner*—Sandra L. O'Shea
*Assistant Examiner*—Jay M. Patidar
*Attorney, Agent, or Firm*—Warren L. Franz; Wade James Brady, III; Richard L. Donaldson

[57] ABSTRACT

A face plate (10) of an FED image display has a grooved rear surface (25) formed with projections (36). Projections (36) have surfaces (39) covered in regions (58, 59) with electrical conductive material (54) and different color emitting phosphor particles (56a, 56b). The regions (58, 59) define different color anode combs. Surfaces (39) in regions (61) between regions (58,59) are covered with insulative, light absorbing material (62) for absorption of ambient light. Surfaces (39) are formed to encourage forward direction of phosphor-emitted light. In one embodiment, surfaces (39) serve to channel ambient light rearwardly toward projection apexes (40) which are covered with light absorbing material (62). Projections (36) may be parallel elongated prisms, pyramids or cones.

19 Claims, 3 Drawing Sheets

GROOVED ANODE PLATE FOR CATHODOLUMINESCENT DISPLAY DEVICE

This invention relates generally to image display devices; and, in particular, to image display devices having transparent face plates including electrodes and luminescent coatings.

BACKGROUND OF THE INVENTION

The term "flat-panel display" as used herein refers to field emission displays (FEDs) and other flat-panel displays, such as addressed in Tannans, *Flat-Panel Displays and CRTs* (1985 Van Nostrand Reinhold). In this context, the term "flat" has reference to thinness, not planarity.

Flat-panel displays are widely used as imaging screens for laptop and notebook computers, but are not limited to such applications.

Conventional image display devices employing luminescent materials suffer from inefficiency in image generation. The directivity of light emitted by phosphor particles, for example, is generally random and uncontrolled. A portion of the total generated light is lost due to back emissions that never reach the viewer. The phosphor of luminescent displays is conventionally deposited over a smooth, slightly curved or planar surface, oriented generally normal to the incoming electron stream. Thus, to avoid loss of image due to passage of electrons between adjacent phosphor particles, the phosphor is deposited in multiple layers, so outer layer particles cover interstices between inner lay particles. This increases the operating power requirement in FED displays, however, because of higher resistance paths between outer layer particles and the associated anode stripes. Moreover, also relating to FED displays, it is well-known that phosphor light emission efficiency decreases with incident electron current density. This problem exists with traditional CRT displays but is especially troublesome with flat-panel displays which typically operate at lower power and under often brighter ambient light conditions. It is, therefore, desirable to be able to construct an anode plate for an FED image display which has increased phosphor surface area, without sacrificing high resolution pixel size.

Flat-panel displays also suffer from contrast ratio reduction and glare due to reflections of ambient light from the face plate. This is of particular concern with displays employing face plates having phosphor luminescent coatings because such displays are subject to much greater contrast ratio reduction due to reflections of ambient light from the anode stripes and granular phosphor. It is, therefore, desirable to be able to construct an anode plate for an FED image display which has reduced ambient light reflection, without sacrificing image intensity.

Various structures and treatments have been proposed to address the problem of ambient light reflection, including the provision of surface irregularities and patterns which function as ambient light scattering elements to redirect reflections of the incident ambient light out of the angle of view of the viewer. An example of such treatment is given in U.S. Pat. No. 5,240,748 wherein a shallow pattern of 0.1 μm depth is ablated by UV light on the inside surface of a CRT display. However, though scattering reduces reflections at certain viewing angles, non-productive light (i.e., light that is not part of the image-formative process) is still returned to the viewer.

U.S. Pat. No. 5,206,746 discloses a transparent plate having a rear surface with a side-by-side array of triangular prisms that is interposed as a unidirectional light trap between liquid crystal and backlighting components of a liquid crystal display. Ambient light incident on the bottoms of the prisms is internally reflected at the prism side surfaces and directed toward the tops of the prisms where it is absorbed by a coating of light absorbing material. Light traveling in the opposite direction from the backlighting source is, however, relatively unaffected and passes through to the viewer, or is blocked, in accordance with the pass/no-pass mode imparted to the liquid crystals. The '746 structure constitutes an independent element, separate and apart from the active image-forming liquid crystal and backlighting components.

Applicant's copending application U.S. Ser. No. 08/347,011, entitled "Ambient Light Absorbing Face Plate For Flat Panel Display," discloses a transparent face plate for a cathodoluminescent display having a rear surface prism array, wherein tops of the prisms are covered not only with light absorbing material, but also with electrically conductive material. The conductive material is connected to serve as anode stripes for excitation of phosphor granules deposited over the coated tops. This arrangement enables the compact construction of an FED display having improved contrast ratio and reduced electrical surface leakage between adjacent different colored phosphor stripes.

The full disclosures of U.S. Pat. Nos. 5,206,746 and 5,240,748, and of copending U.S. Ser. No. 08/347,011, are incorporated herein by reference.

SUMMARY OF THE INVENTION

The invention provides a face plate for an image display device having a luminescent coating, such as an anode plate for a cathodoluminescent display, that exhibits good luminescent efficiency. The invention further provides such a face plate having good contrast ratio under varying ambient light conditions.

In accordance with one aspect of the invention, a face plate for an image display device has a plate of transparent material including a rear surface having a plurality of grooves defining ridges, valleys and sloped connecting surfaces and having a layer of luminescent material deposited within the grooves and covering the connecting surfaces. In an illustrative embodiment of an anode plate for a cathodoluminescent display, described further below, a layer of conductive material underlies a layer of cathodoluminescent material and electrons are emitted toward the anode plate at slant incident angles with the respect to normal to the connecting surfaces. This avoids the necessity to cover interstices between luminescing particles and enables the material (viz. granular phosphor particles) to be deposited substantially as a single layer. Moreover, such grooved surface phosphor coating arrangement also enables the recovery of light from back emissions.

In accordance with another aspect of the invention the grooves define periodically arrayed projections that are dimensioned, configured and adapted to function as light traps to prevent ambient light which enters the front surface of the plate from reflecting off the phosphor. In a preferred side-by-side arrangement of alternating parallel ridges and valleys, ambient light entering the face plate front surface is directed out through the ridge apexes, which may optionally be covered with light absorbing material.

BRIEF DESCRIPTION OF THE DRAWINGS

Embodiments of the invention have been chosen for purposes of illustration and description, and are shown with reference to the accompanying drawings, wherein.

Throughout the drawings, like elements are referred to by like numerals.

DETAILED DESCRIPTION OF PREFERRED EMBODIMENTS

Figure 1:
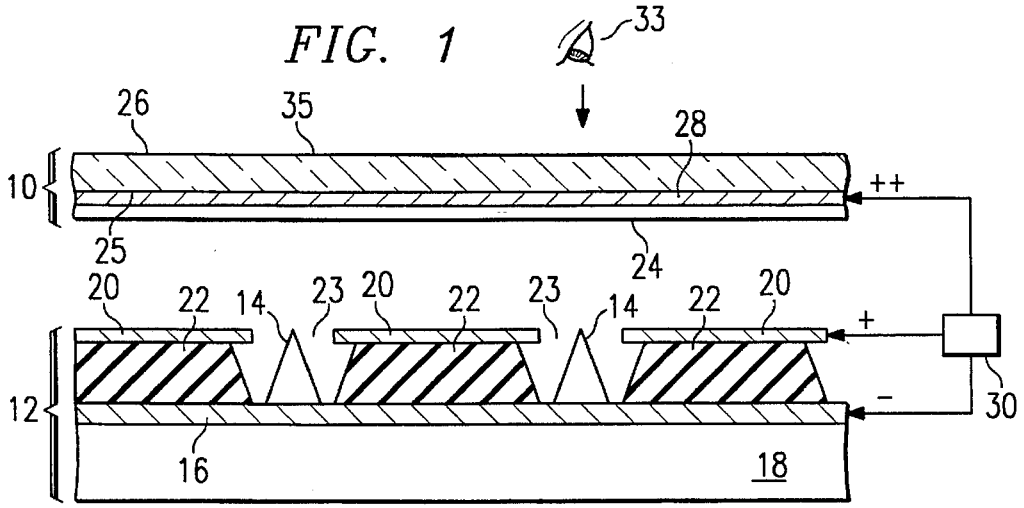
FIG. 1 is a cross-sectional view of a field emission display (FED) device of the type to which the present invention finds particular application.
Figure 2:
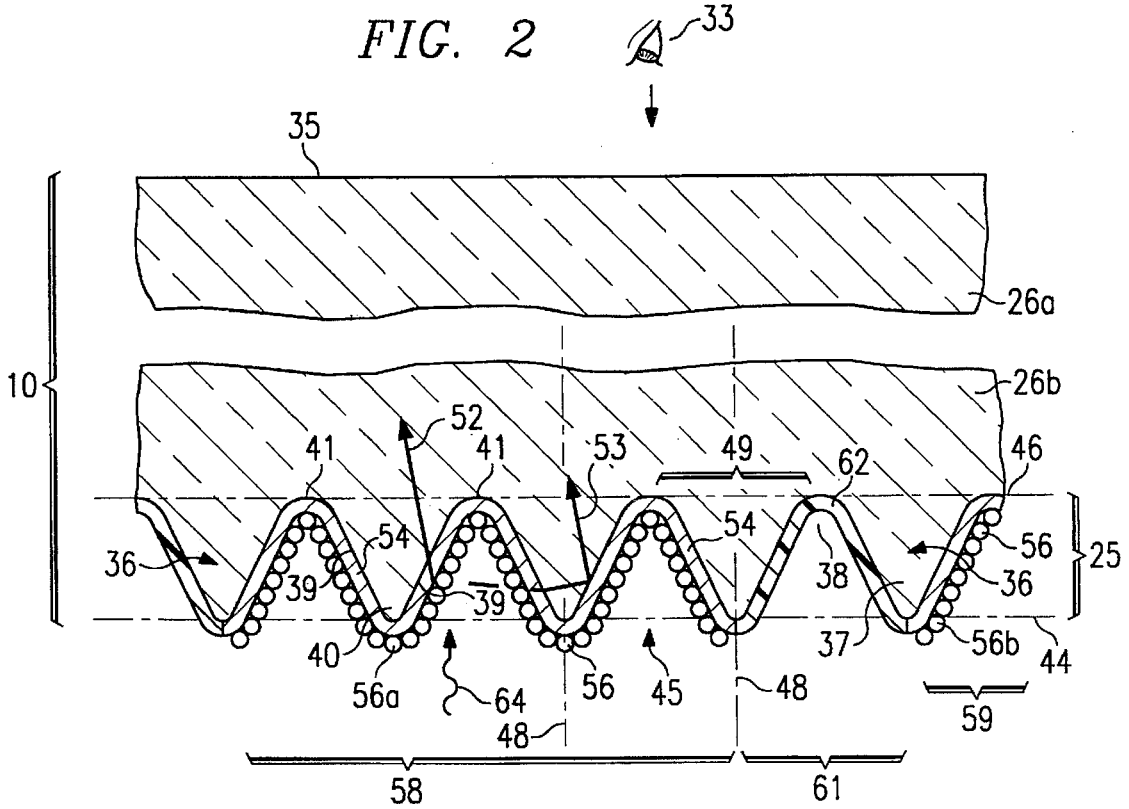
FIG. 2 is an enlarged cross-sectional view of an embodiment of an anode plate in accordance with the invention, usable in the device of FIG. 1.

An FED image display device in accordance with the invention is illustrated in FIGS. 1 and 2. An anode face plate 10 is spaced apart in known way across a vacuum gap from an electron emitter or cathode plate 12. Plate 12 comprises a cathode electrode having a multiplicity of electrically conductive microtips 14 in electrical communication with an electrically conductive layer 16 of stripes formed on a upper surface of an electrically insulating substrate 18. An extraction or gate electrode 20 is comprised of an electrically conductive layer of cross-stripes deposited on an insulating layer 22 which serves to electrically insulate electrode 20 and space it from the stripes of conductive layer 16. Microtips 14 are in the shape of cones which are formed within apertures 23 through conductive layer 20 and insulating layer 22. The relative parameters of microtips 14, conductive layer 20 and insulating layer 22 are chosen to place the top or apex of each microtip 14 generally at the layer of level 20.

Anode plate 10 comprises an electrically conductive layer of material 28 deposited on a transparent (viz. glass) substrate 26 which is positioned facing extraction electrode 20 and parallel thereto. The conductive layer 28 is deposited on a rear or inside surface 25 of substrate 26, directly facing extraction electrode 20. Conductive layer 28 may be in the form of a continuous single electrode deposited over the entire imaging region of surface 25; or, alternatively, may be in the form of a plurality of electrically isolated electrode combs, such as taught in U.S. Pat. No. 5,225,820 and more fully described in copending application U.S. Ser. No. 08/347,011. Anode plate 10 also comprises phosphor luminescent material 24 deposited over the conductive layer 28, so as to be directly facing extraction electrode 20. Phosphor material 24 may be applied to conductive layer 28 using an electrophoretic deposition or other known process.

Following conventional teachings, one or more of the microtip emitters 14 can be energized by applying a negative potential to a stripe of layer 16 relative to an intersecting cross-stripe of the extraction electrode 20 via a voltage source 30, thereby inducing an electric field which pulls electrons from microtips 14. The freed electrons are accelerated toward the anode plate 10 which is positively biased by the application of a substantially larger positive voltage from voltage source 30 applied between the extraction electrode 20 and conductive layer 28. Energy from the electrons emitted by the cathode electrode 16 and attracted to the anode electrode 28 is transferred to the phosphor material 24, resulting in luminescence. Electron charge is transferred from phosphor material 24 to conductive layer 28, completing the electrical circuit to voltage supply 30.

Using known techniques, intersections of stripes of cathode layer 16 and cross-stripes of gate layer 20 can be individually matrix-addressed to provide selective pixel illumination of corresponding phosphor areas, to develop an image viewable to a viewer 33 looking at the front or outside surface 35 of the plate 10. All the electronic circuitry of the display, including the voltage source, may be integrated into the emitter plate 12, with the exception of the conductor 28 which comprises the anode electrode which is included in the anode plate 10. In the case of a single conductive electrode 28 spread across the surface 25 of support 26, one electrical connection is required between the emitter plate 12 and the anode plate 10. Where, however, the anode comprises three electrodes in the form of electrically isolated combs, as taught in U.S. Pat. No. 5,225,820, three electrical connections are required between the emitter plate 12 and the anode plate 10.

In accordance with the principles of the invention, rear surface 25 of anode plate 10 is grooved to provide a periodic array of projections 36, and groove recesses 45 defined by alternating ridges 37 and valleys 38, with slope connecting surfaces 39 converging rearwardly at ridge tops or apexes 40 and forwardly at valley bottoms 41. Projections 36, groove recess 45 are positioned side-by-side in juxtaposition, with ridge tops 40 aligned along an imaginary plane 44 and valley bottoms 41 aligned along an imaginary plane 46. Planes 44 and 46 are preferably generally parallel to each other and to said front surface 35.

The embodiment of FIG. 2 has projections 36 and groove recesses 45 rounded to present a general sinusoidal curvature in cross-section, with sloped surfaces 39 oriented symmetrically relative to central axes 48 orthogonal to projections bases 49. To facilitate bussing and promote image uniformity, projections 36 are formed by parallel elongated grooves or channels 45 to present isosceles prisms 36 having equal, oppositely sloping segmented or continuous walls 39. If desired, it is also possible to provide projections 36 with pyramidal or conical shapes, by cross-grooves extended transversely to the parallel and groove recesses. In any event, the grooves 45 have dimensions sufficient to accommodate phosphor particles in a conformal layer within the grooves, as described below.

As seen in FIG. 2, connecting surfaces 39 are first covered with a conformal layer of transparent electrically conductive material 54, such as indium-tin oxide (ITO). One or more layers of thin film phosphor particles 56 are then conformally deposited over the material 54. The conductive material 54 serves as the anode electrode 28 shown in FIG. 1. The phosphor layer 56 corresponds to the phosphor coating 24 shown in FIG. 1. The size of the phosphor particles 56 is such that, when deposited, they will generally follow the contours of the valleys 38 and connecting surfaces 39. For the embodiment of FIG. 2, the tops 40 of ridges 37 of projections 36 are also covered with conductive material 54 and phosphor 56.

For an anode plate 10 suitable for monochrome display, the connecting surfaces 39 and valleys 38 of all groves 45 in the imaging region of the display can be all covered with conductive material 54 and phosphor 56. The conductive material is commonly connected to form a single anode electrode 28 covering substantially the whole of the imaging region of the surface 25 of plate 10. For a color display, the conductive material is, however, laid down only in selected areas 58, 59 of grouped juxtaposed protrusions 36, as shown in FIG. 2. The different conductive layer groupings 58, 59 are then respectively connected by electrically isolated stripes of the same or different conductive material deposited outside of the imaging region, marginally on inside surface 25 of plate 26. The joined groupings 58, 59 thereby form three separately activatable electrode combs, one for each primary color. Different phosphorescent materials 56*a*, 56*b*, with different color emissivities, which luminesce in different ones of the primary colors, are then applied in the layer 56 to the groupings 58, 59 of the respective combs, to form the separate red, green and blue color anode bands used for display of a color image. Areas 61 of surface 25 located in the separations between adjacent, different comb areas 58, 59 are left uncovered or, as shown in FIG. 2, are optionally covered with a layer of material 62 which may be insulative, light absorbing, or both insulative and light absorbing.

Placing the phosphor 56 conformally on the undulated surface 25 improves the efficiency of the image generation process in several ways. Electrons 64 emitted by microtips 14 (FIG. 1) and attracted by the anode electrode 28 (ITO material 54) will strike the phosphor layer 56 at slant incident angles (typically on the average of 10°–30° to the surface, or 60°–80° to the normal) to the connecting surfaces 39. This substantially slanted incidence minimizes the probability that a particular electron 54 will strike a space between adjacent phosphor particles 56, as compared with conventional arrangements for which incidence is substantially normal to the phosphor layer. Thus, the layer 56 can be made thinner (viz. fewer number of particles) than conventional layers which had to be applied in multiple particle thicknesses so as to insure that interstices in one row of particles were filled in, or covered, by particles in a subsequent row. The thinner layer has a lower resistive path. Also, since pixel size is measured parallel to the plane of plate 10 (coplanar with planes 44 and 44), the phosphor particle-filled grooved surface 25 has a greater surface area of phosphor coating 56 for the same given pixel area than phosphor coatings of prior art arrangements. Thus, the current density is less for the same image intensity, giving greater phosphor emission efficiency.

Moreover, as can be seen in FIG. 2, the wavy phosphor layer 56 enables recovery of some of the back emissions. With conventional planar phosphor layers, when light is emitted by the phosphor in a direction away from the plate, it is completely lost. With the arrangement of FIG. 2, however, because of the contour of connecting surfaces 39, at least some of the back emitted light 53 will be directed across a void or valley 38 toward an adjacent connecting surface 39, where it can be recaptured by the diffusion effects of the phosphor on that surface, and redirected and recovered back into the plate 10. Once inside plate 10, the forward divergence of connecting surfaces 39 within the glass interior of projections 36 serves to focus emitted light 53 in a direction toward front surface 35.

The grooves in areas 61 which do not include conductive material 54 serve to separate and electrically isolate anode electrical stripes 58, 59 from each other, thereby reducing surface leakage. Arcing between different color phosphor anode stripes is minimized in FED displays by drawing and maintaining a vacuum in the space between anode and emitter plates. However, voltage standoff between different color combs at high voltages can still be a problem in conventional devices because of surface leakage between conventional coplanar razor edges of the separate electrode depositions deposited across a smooth back surface of the shared face plate. Such leakage is a precursor to arcing. With the undulating surface of the invention, such surface leakage is minimized by eliminating sharp edges in the conductor 54 and by the increased surface distances across the isolation zones 61 between adjacent stripes of different color combs. Use of an insulating material 62 in areas 61 further reduces such leakage.

A typical envisioned arrangement has a pixel pitch of 300 microns, or 100 microns for each color (approximately 66 microns per phosphor stripe and 34 microns per separation). It has a projection pitch (ridge center axis 48-to-ridge center axis 48) of 5–35 microns, with projection depths (separation between planes 46 and 44) of about 4–28 microns, or more. Phosphor layer 56 may utilize phosphor particles from 1–5 microns diameter, with 1 micron particles being preferred. Thus, for pixel widths of 300 microns, each color will have an area 58, 59 typically encompassing 2–13 projections 36, with intervening non-phosphor areas 61 encompassing about 1–7 projections 36. Typical glass plate thickness (separation between surfaces 25 and 35) will be about 1100 microns.

Figure 3:
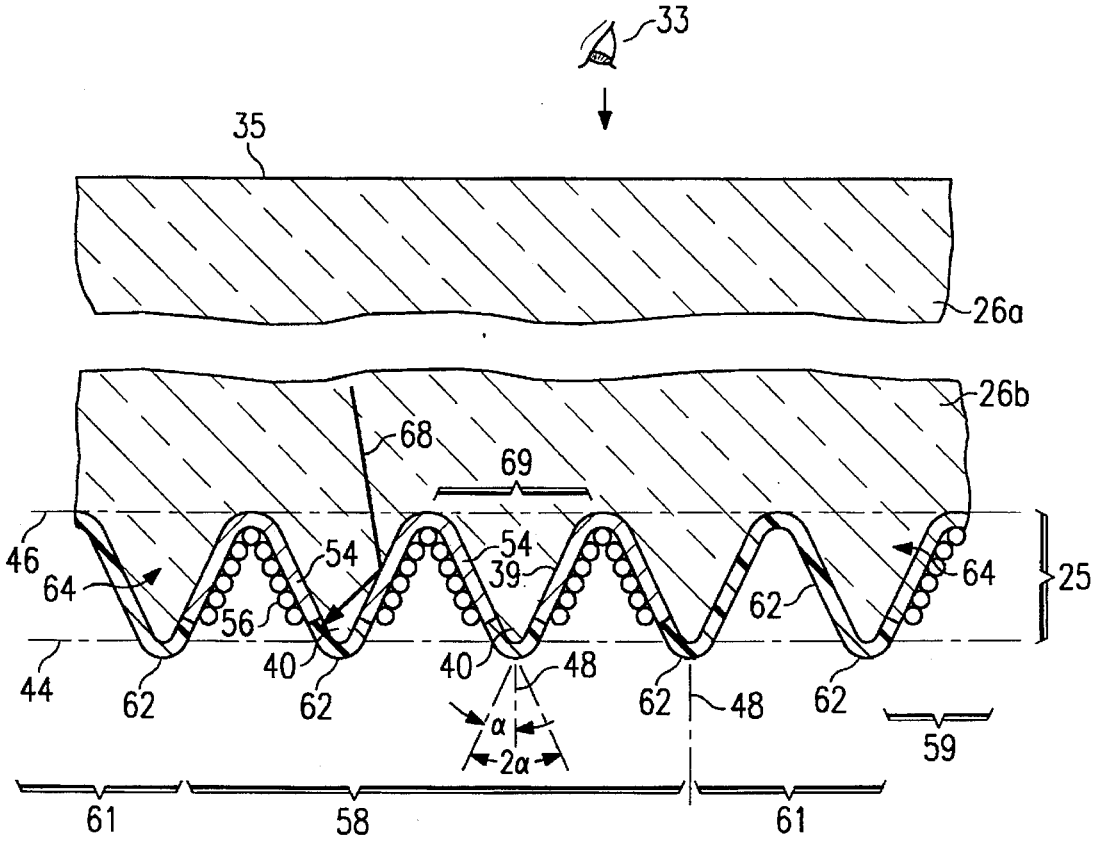
FIG. 3 is a similar view, of a modified embodiment of the anode plate of FIG. 2.

FIG. 3 shows a modified form of grooved surface 25, wherein the projections 36 are configured to present a sawtoothed cross-sectional configuration of juxtaposed isosceles generally triangular prisms 64. The prisms 64 have equal, oppositely sloping walls 39 converging rearwardly and inwardly from plane 46 toward plane 44 at angles of convergence $2\alpha$ (half-angles $\alpha$). The prisms function to direct ambient light 68 rearwardly toward prism apexes 40, which are left uncovered by conductive material 54 (even in regions 58, 59), but are covered with light absorbing material 62. Angles $\alpha$ are chosen to maximize directivity of phosphor emitted light 52, 53 (see FIG. 2) from rear surface 25, forwardly through apertures defined by bases 69 of projections 36, and to maximize transmission of ambient light 68 rearwardly toward apexes 40. Angles $\alpha$ may be less than 30°, with angles $\alpha$ of 10°–25° being typical. Although isosceles construction in the illustrated cross-section is shown, non-isosceles cross-sectional configurations are also possible which will decrease ambient light reflectivity.

In the modification of FIG. 3, the conductive and phosphor materials 54, 56 cover about two-thirds of the rise of sloped walls 39 between planes 46 and 44. Projections 36 may also be blunted or truncated at apexes 40 to provide planar exit windows for ambient light. Plate 10 may be formed as an integrated structure using a single substrate element 26, or may be of laminar construction, such as where a front portion 26*a* of substrate 26 is merged with a rear portion 26*b* after the surface grooves are formed. The structures of projections 36 may be formed by any suitable mechanism.

One method of forming the plate 10 of FIG. 2, for a multi-comb electrode display, is illustrated schematically in FIGS. 4A–4G (not to scale).

Figure 4A:
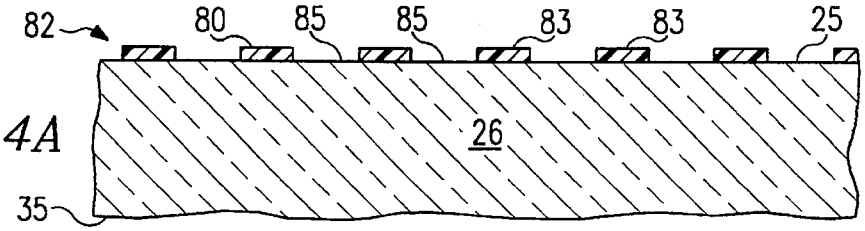
FIGS. 4A–4G are schematic views showing successive steps in a method of manufacture of the anode plate.
Figure 4B:
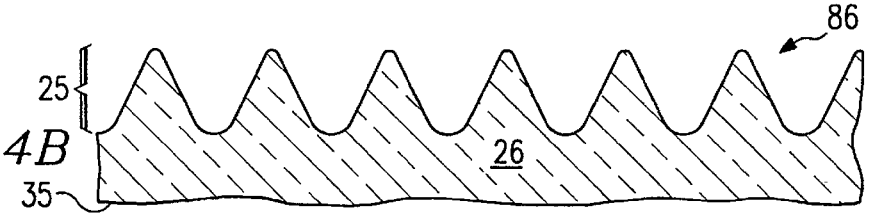

An inside surface 25 of a transparent rectangular glass plate 26 is uniformly coated with a layer of photoresist 80. The photoresist 80 is exposed and developed to remove portions of photoresist 80, leaving a pattern 82 of longitudinally or laterally extending bands 83 of unremoved portions of photoresist 80, separated by intervening gaps 85, as illustrated in FIG. 4A. One or more additional layers of photoresist (not shown) may be applied in separate masking steps to form the marginal areas away from the active imaging region for the purpose of optionally constructing anode driver electronics, or the like. The plate 26, covered with photoresist grating 82, is then subjected to etching to form a grooved, sinusoidal cross-sectional configuration 86 of surface 25 defining juxtaposed projections 36, as shown in FIG. 4B. The separately masked marginal regions of plate 26 are left unetched, to provide a stable platform for driver electronics, interconnections, etc. The configuration 86 can likewise be developed using mechanical cutting or other known techniques.

Figure 4C:
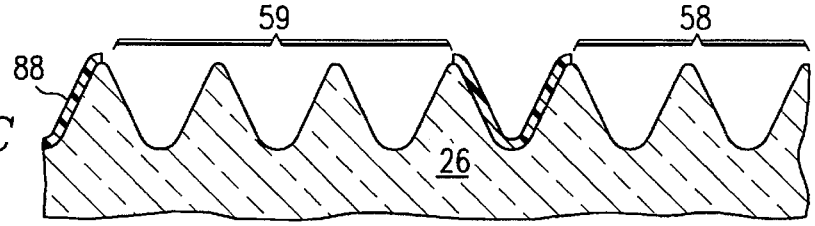
Figure 4D:
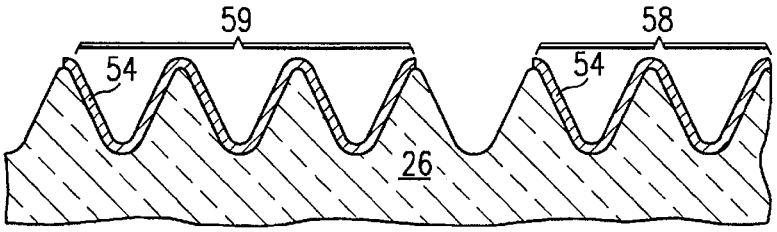
Figure 4E:
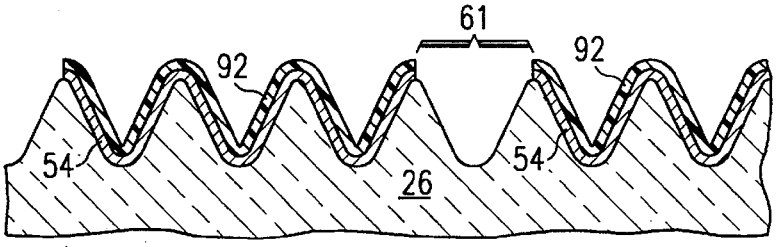
Figure 4F:
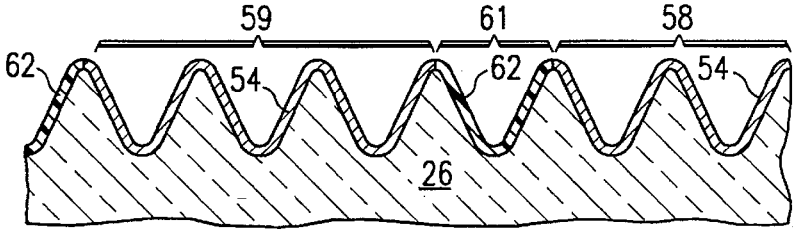
Figure 4G:
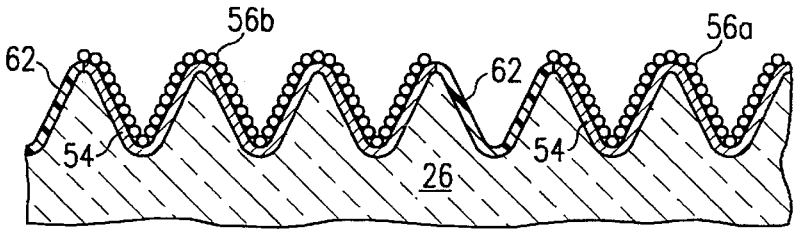

Next, as shown in FIG. 4C, a layer of photoresist 88 is applied and patterned to define the regions 58, 59 to be covered with conductive material 54. A layer of indium-tin oxide 54 is then deposited onto surface 25 to cover the ridges and valleys of projections 36 in areas 58, 59. Another layer of photoresist 92 is then deposited, and patterned to form the comb isolating areas 61 onto which insulative light absorbing material 62 is to be added (FIG. 4F). Phosphor material 56*a*, 56*b* is then deposited by suitable mechanism, such as electrophoretic deposition, over the conductor layer 54 to cover the ridges and valleys of projections 36 in areas 58, 59, as shown in FIG. 4G.

To achieve the structure of FIG. 3, the conductive material deposition and light absorbing material deposition steps are modified to pattern the depositions of those materials accordingly. Deposition of phosphor 60 by electrophoretic deposition results in modified placement of the phosphor, as indicated, with a multiplicity of particles 60 within each groove.

Those skilled in the art to which the invention relates will appreciate that other substitutions and modifications can be made to the described embodiment, without departing from the spirit and scope of the invention as defined by the claims below.

What is claimed is:

1. An anode plate for a cathodoluminescent display, comprising:

a substrate of transparent material having a surface;

said surface having a plurality of grooves defining ridges and valleys joined by sloped connecting surfaces;

a layer of electrically conductive material conformally deposited within said grooves to cover at least said sloped connecting surfaces; and a layer of cathodoluminescent material conformally deposited on at least said sloped connecting surfaces over said electrically conductive material.

2. The anode plate of claim 1, wherein said cathodoluminescent material layer comprises phosphor particles within said grooves.

3. The anode plate of claim 2, wherein said grooves have groove depths and groove ridge-to-ridge spacings; and wherein said groove depths are at least 80% as great as said groove spacings.

4. The anode plate of claim 3, wherein said grooves define parallel elongated prisms having side walls; wherein said sloped connecting surfaces comprise said side walls; and wherein said cathodoluminescent material is deposited within said grooves at least on said side walls.

5. The anode plate of claim 4, wherein said layer of electrically conductive material comprises a transparent conductive coating; and wherein said layer of cathodoluminescent material comprises phosphor particles.

6. The anode plate of claim 5, wherein said layer of cathodoluminescent material comprises a substantially single layer of phosphor particles.

7. An anode plate for a cathodoluminescent display, comprising:

a substrate of transparent material having a surface which is grooved to provide a periodic array of projections and recesses, defined by alternating ridges and valleys, with sloped connecting surfaces converging rearwardly at ridge tops and forwardly at valley bottoms;

first and second stripes of electrically conductive material deposited in laterally separated positions, conformally over said surface within said grooves providing respective different pluralities of said projections and recesses;

cathodoluminescent material of a given color emissivity deposited conformally over said grooved surface over said conductive material of said first stripe; and cathodoluminescent material of a different color emissivity deposited conformally over said grooved surface over said conductive material of said second stripe.

8. The anode plate of claim 7, further comprising electrically insulative material deposited conformally over said grooved surface within said grooves providing ones of said projections and recesses located between said laterally separated positions.

9. The anode plate of claim 7, further comprising light absorbing material deposited conformally over said grooved surface within said grooves providing ones of said projections and recesses located between said laterally separated positions.

10. The anode plate of claim 9, wherein said light absorbing material is an electrically insulative material.

11. The anode plato of claim 7, wherein said projections comprise a periodic array of isosceles prisms.

12. The plate of claim 7, wherein said projections comprise pyramids or cones.

13. The plate of claim 7, wherein said ridge tops of said projections are left uncovered by said phosphor particles at said ridge tops.

14. The plate of claim 13, further comprising a layer of light absorbing material covering said ridge tops.

15. The anode plate of claim 7, wherein said projections are positioned side by side in juxtaposition, with ridge tops aligned along a first imaginary plane and valley bottoms aligned along a second imaginary plane parallel to said first imaginary plane.

16. The anode plate of claim 7, wherein said cathodoluminescent material comprises phosphor particles.

17. An image display device comprising the anode plate of claim 7 in combination with a cathode plate spaced from said anode plate; said cathode plate comprising a plate of material having a surface facing said grooved surface of said anode plate, and a plurality of electrically conductive microtips formed on said cathode plate surface.

18. An image display device comprising the anode plate of claim 1 in combination with:

a cathode plate spaced from said anode plate; said cathode plate comprising a plate of material having a surface facing said grooved surface of said anode plate, and a plurality of electrically conductive microtips formed on said cathode plate surface.

19. The image display device of claim 18, wherein said sloped surfaces are configured relative to said cathodoluminescent material for enhancing transmission of phosphor emitted light through said anode plate and for decreasing reflection of ambient light from said cathodoluminescent material.

* * * * *